United States Patent [19]

Moriguchi et al.

[11] Patent Number: 4,514,736

[45] Date of Patent: Apr. 30, 1985

[54] THERMAL HEAD

[75] Inventors: Haruhiko Moriguchi; Toshiharu Inui, both of Kanagawa, Japan

[73] Assignee: Fuji Xerox Co., Ltd., Tokyo, Japan

[21] Appl. No.: 455,711

[22] Filed: Jan. 5, 1983

[30] Foreign Application Priority Data

Jan. 13, 1982 [JP] Japan ..... 57-2686

[51] Int. Cl.[3] ..... H05B 1/100

[52] U.S. Cl. ..... 346/76 PH; 219/216 PH; 219/539

[58] Field of Search ..... 346/76 R, 76 PH; 219/216 PH, 216, 543, 539; 340/825.79; 400/120; 250/317.1, 318

[56] References Cited

U.S. PATENT DOCUMENTS

| | | | |
|---|---|---|---|
| 3,518,406 | 6/1970 | Janning | 346/76 PH |
| 3,577,137 | 12/1971 | Brennan, Jr. | 346/76 PH |
| 3,596,055 | 5/1971 | Eiston | 346/76 PH |
| 4,020,465 | 4/1977 | Cochran et al. | 346/76 PH |
| 4,429,318 | 1/1984 | Kobuta | 346/76 PH |

*Primary Examiner*—E. A. Goldberg
*Assistant Examiner*—A. Evans
*Attorney, Agent, or Firm*—Sughrue, Mion, Zinn, Macpeak & Seas

[57] ABSTRACT

A thermal head is provided with first and second sets of parallel bar-shaped electrodes which are arranged in slightly spaced parallel planes and cross over one another. Individual crossing resistors are selectively energized to produce a heat generating dot which may be reproduced on a heat sensitive media.

2 Claims, 6 Drawing Figures

THERMAL HEAD

BACKGROUND OF THE INVENTION

This invention relates to thermal heads employed in recording apparatuses using heat-sensitive recording media, and more particularly to a thermal head of simple construction which can provide recording dots of a small size.

FIG. 1 is a diagramatic plan view showing one example of a conventional, ordinary thermal head.

In FIG. 1, reference characters 1*a*, 1*b*, 1*c* and so on designate a group of heat generating elements, and reference characters 2*a*, 2*b*, 2*c* and so on designate a group of lead electrodes connected to the respective heat generating elements in a manner such that they are on one side of the group of heat generating elements and are in parallel with one another.

In the thermal head thus constructed, current is applied to the lead electrodes 2*a* and 2*b* to allow the heat generating element 1*a* to record data, and current is applied to lead electrodes 2*b* and 2*c* to cause the heat generating element 1*b* to record data, etc.

FIG. 2 is a diagramatic plan view of another example of a conventional thermal head.

In FIG. 2, reference characters 3*a*, 3*b*, 3*c* and so forth designate a group of heat generating elements, and reference characters 4*a*, 4*b*, 4*c* and so forth designate a group of lead electrodes connected to the respective heat generating elements in a manner such that they are alternately arranged on either side of the group of heat generating elements 3*a*, 3*b*, 3*c*, and are in parallel with one another.

In the thermal head thus constructed, in order to cause the heat generating element 3*a* to record data, current is applied to the lead electrodes 4*a* and 4*b*; and similarly, in order to cause the heat generating element 3*b* to record data, current is applied to lead electrodes 4*b* and 4*c*.

The above-described conventional thermal heads suffer from drawbacks in that it is rather difficult to arrange the heat generating elements in matrix form because the construction thereof becomes intricate, and accordingly it is also difficult to decrease the size of the recording dots.

SUMMARY OF THE INVENTION

An object of this invention is to provide a thermal head in which the above-described difficulties accompanying the conventional thermal head have been eliminated, whereby the construction is made simple and the size of recording dots can be made small.

The foregoing object and other objects of the invention have been achieved by the provision of a thermal head which, according to the invention, comprises: first bar-shaped heat generating resistors arranged in a first plane in a manner such that they are substantially parallel to one another; and second bar-shaped heat generating resistors arranged in a second plane in parallel with the first plane in a manner such that they are substantially parallel to one another, the first bar-shaped.heat generating resistors crossing the second bar-shaped heat generating resistors to provide heat generating dots at the crossing points.

DETAILED DESCRIPTION OF THE PREFERRED EMBODIMENTS

Figure 3:
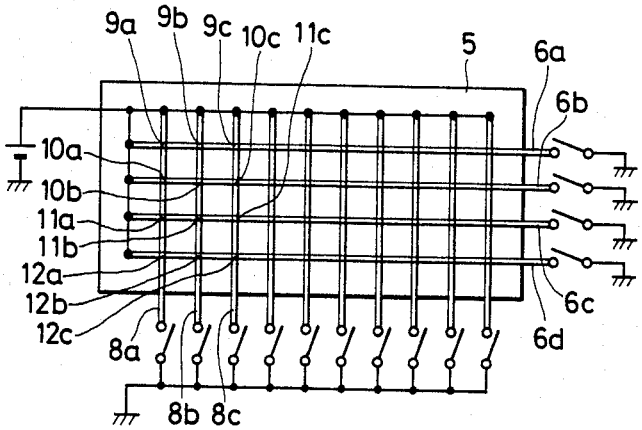
FIG. 3 is an explanatory diagram showing the positional relationship of heat generating elements and the electrical connection of the same in a thermal head according to a first embodiment of the invention.
Figure 4:
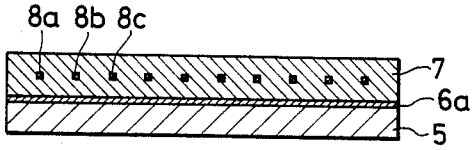
FIG. 4 is a diagramatic sectional view of the thermal head of FIG. 3.

In FIGS. 3 and 4, reference numeral 5 designates an insulating substrate; 6*a* through 6*d*, lower bar-shaped heat generating resistors arranged on the insulating substrate 5 in a manner such that they are substantially parallel to one another; and 7, a wear-resisting layer formed so as to cover the insulating substrate 5 and the lower bar-shaped heat generating resistors 6*a* through 6*d*.

Further in FIGS. 3 and 4, reference characters 8*a*, 8*b*, 8*c* and so on designate upper bar-shaped heat generating resistors arranged substantially parallel to one another within the wear-resisting layer 7, i.e., in a plane substantially parallel to the plane of the lower bar-shaped heat generating resistors 6*a* through 6*d*. The resistors 8*a*, 8*b* . . . are disposed such that they cross over the heat generating resistors 6*a* through 6*d*, creating points of intersection in the plan view of FIG. 3.

Further in FIGS. 3 and 4, reference characters 9*a*, 9*b*, 9*c* . . . , 10*a*, 10*b*, . . . , 11*a*, 11*b*, . . . and 12*a*, 12*b*, . . . designate the noted crossing points of the upper bar-shaped heat generating resistors 6*a* through 6*d* and lower bar-shaped heat generating resistors 8*a*, 8*b* and so on, respectively, namely, heat generating dots.

Switches are connected to the lower bar-shaped heat generating resistors 6*a* through 6*d* so that the latter may be energized successively in agreement with the conveyance of a recording sheet, and switches are connected to the upper bar-shaped heat generating resistors 8*a*, 8*b*, 8*c* and so on so that current may be applied to the latter according to an input video signal.

The data recording operation of the thermal head thus constructed will now be described.

In the case of recording data using the heat generating dots 9*a*, 9*b*, . . . of the first line, current is applied to the lower bar-shaped heat generating resistor 6*a*, and the upper bar-shaped heat generating resistors 8*a*, 8*b*, . . . are selectively energized according to the input video signal.

The crossing points (or the heat generating dots) of the upper and lower bar-shaped heat generating resistors 8*a*, 8*b*, . . . and 6*a* through 6*d*, where the upper bar-shaped heat generating resistors are selectively energized are heated to a higher temperature which permits thermal recording, because the heat generated by two (e.g. 6*a*, 8*a*; 6*a*, 8*b*, etc.) bar-shaped heat generating resistors is added. However, those portions of the thermal head where no such crossing point exists, or where two quantities of heat are not so added together, are not heated to such a high temperature, and thus do not affect the recording.

In recording data with the heat generating dots 10*a*, 10*b*, . . . of the second line, current is applied to the lower bar-shaped heat generating resistor 6*b*, while the upper bar-shaped heat generating resistors 8*a*, 8*b* . . . are selectively energized according to the input video signal.

In recording data using the heat generating dots 11*a*, 11*b*, . . . of the third line or with the heat generating dots 12*a*, 12*b*, . . . of the fourth line, the procedure is similar to that employed in recording data with the dots of the first or second lines.

The size of the dots thus recorded depends on the width of the upper and lower bar-shaped heat generating resistors. Accordingly, recorded dots of small size can be obtained by merely reducing the width of the resistors.

In experiments performed by the inventors, the insulating substrate 5 was made of alumina, and the upper and lower bar-shaped heat generating resistors 8*a*, 8*b*, . . . and 6*a* through 6*d* were made of ruthenium oxide. In addition, the wear-resisting layer was made of a hard (lead) glass, and gold electrodes were employed.

With the thermal head as described above, a recording operation was carried out in the above-described manner. As a result, an image of small dot size and high resolution was recorded.

Figure 5:
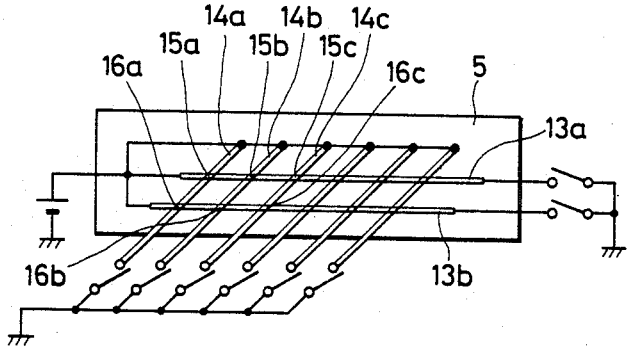
FIG. 5 is an explanatory diagram showing the arrangement and the electrical connection of heat generating elements in a thermal head according to a second embodiment of the invention.

FIG. 5 is a diagram showing the positional relationship between the heat generating resistors and the electrical connection of the same according to a second embodiment of the invention. In FIG. 5, reference numeral 5 designates an insulating substrate; 13*a* and 13*b*, the lower bar-shaped heat generating resistors, which are arranged substantially parallel to each other on the insulating substrate 5; and 14*a*, 14*b*, and so on, the upper bar-shaped heat generating resistors, which are arranged so as to be substantially parallel to one another and oblique to the lower bar-shaped heat generating resistors 13*a* and 13*b*. The heat generating dots 15*a*, 15*b*, . . . and 16*a*, 16*b*, . . . are shifted by ½ pitch with respect to one another from one line to the next.

With the thermal head as described above, an oblique line can easily be recorded as follows: Current is applied to the lower bar-shaped heat generating resistor 13*a* and the upper bar-shaped heat generating resistor 14*a*, to allow the heat generating dot 15*a* to generate heat; and current is then applied to the lower bar-shaped heat generating resistor 13*b* and the upper bar-shaped heat generating resistor 14*b*, to allow the heat generating dot 16*b* to generate heat, etc.

Figure 1:
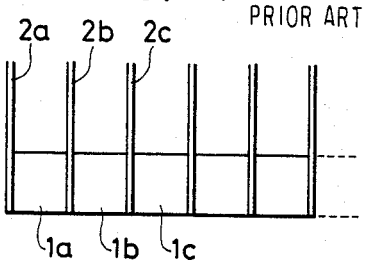
FIG. 1 PRIOR ART
FIGS. 1 and 2 are diagramatic plan views showing heat generating elements of conventional thermal heads.
Figure 2:
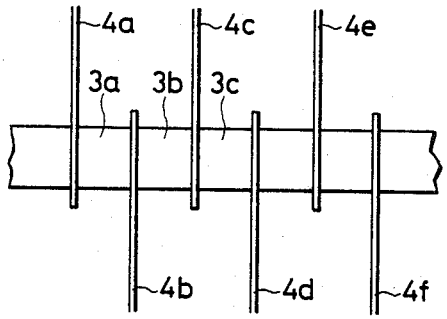
FIG. 2 PRIOR ART
Figure 6:
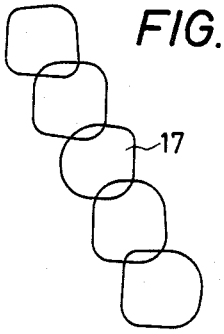
FIG. 6 is an explanatory diagram showing an oblique line recorded with the thermal head of FIG. 5.

In the second embodiment described above, the upper bar-shaped heat generating resistors 14*a*, 14*b*, . . . and the lower bar-shaped heat generating resistors 13*a* and 13*b* are arranged in a manner such that the former and the latter cross each other and are oblique to each other, and the heat generating dots are successively shifted ½ pitch in the main scanning direction. Accordingly, an oblique line of excellent quality, and relatively smooth, as shown in FIG. 6, can be recorded.

As is apparent from the above description, the thermal head of the invention is designed such that the first bar-shaped heat generating resistors are arranged in a first plane in a manner so as to be substantially parallel to one another, while the second bar-shaped heat generating resistors are arranged in a second plane, which is parallel to the first plane, in a parallel manner, the first bar-shaped heat generating resistors crossing the second bar-shaped heat generating resistors to form heat generating dots at the crossing points. Therefore, the thermal head of the invention is advantageous in that it is simple in construction, and can record dots of small size.

What is claimed is:

1. A thermal head comprising, first bar-shaped heat generating resistors arranged in a first plane in a manner so as to be substantially parallel to one another; and second bar-shaped heat generating resistors arranged in a second plane parallel to said first plane and disposed in a manner so as to be substantially parallel to one another;

said first bar-shaped heat generating resistors crossing over said second bar-shaped heat generating resistors to provide heat generating dots at the crossing points;

wherein said first and second bar-shaped resistors cross obliquely, such that crossing points of one line are offset from crossing points of an adjacent line.

2. A thermal head comprising, first bar-shaped heat generating resistors arranged in a first plane in a manner so as to be substantially parallel to one another; and second bar-shaped heat generating resistors arranged in a second plane parallel to said first plane and disposed in a manner so as to be substantially parallel to one another;

said first bar-shaped heat generating resistors crossing over said second bar-shaped heat generating resistors to provide heat generating dots at the crossing points, said thermal head further including a substrate supporting one of said first and second bar-shaped resistors, and a protective layer overlying said substrate, and wherein the other of said first and second bar-shaped resistors are embedded in said protective layer.

* * * * *